United States Patent [19]

Van Zeeland et al.

[11] Patent Number: 4,559,426

[45] Date of Patent: Dec. 17, 1985

[54] MEMBRANE SWITCH AND COMPONENTS HAVING MEANS FOR PREVENTING CREEP

[75] Inventors: Anthony J. Van Zeeland; Willis A. Larson; David A. Christensen, all of Crystal Lake, Ill.

[73] Assignee: Oak Industries Inc., Rancho Bernardo, Calif.

[21] Appl. No.: 203,708

[22] Filed: Nov. 3, 1980

[51] Int. Cl.[4] ..... H01H 3/12

[52] U.S. Cl. ..... 200/159 B; 200/5 A; 200/328

[58] Field of Search ..... 200/159 B, 5 A, 5 E, 200/5 D, 153 J, 160, 328

[56] References Cited

U.S. PATENT DOCUMENTS 3,854,018 12/1924 Reynolds et al. ..... 200/5 E 4,304,973 12/1981 Fenelle et al. ..... 200/159 B

*Primary Examiner*—Willis Little

*Attorney, Agent, or Firm*—Kinzer, Plyer, Dorn & McEachran

[57] ABSTRACT

A membrane switch panel has patches of low creep material attached to the membrane at portions thereof which are subject to creep. Membrane switch panels may be incorporated in keyboards wherein some of the keys may be of the alternate action type. If the alternate action keys are left in an actuated position and the keyboard is stored at a high temperature, the membrane material may be subject to creep. The present invention prevents this by including a stainless steel patch on the membrane under each alternate action type key. The stainless steel patch will not creep at elevated storage temperatures. The patch causes the membrane to be restored to its original location even after being subjected to conditions which would cause the membrane material to creep.

14 Claims, 3 Drawing Figures

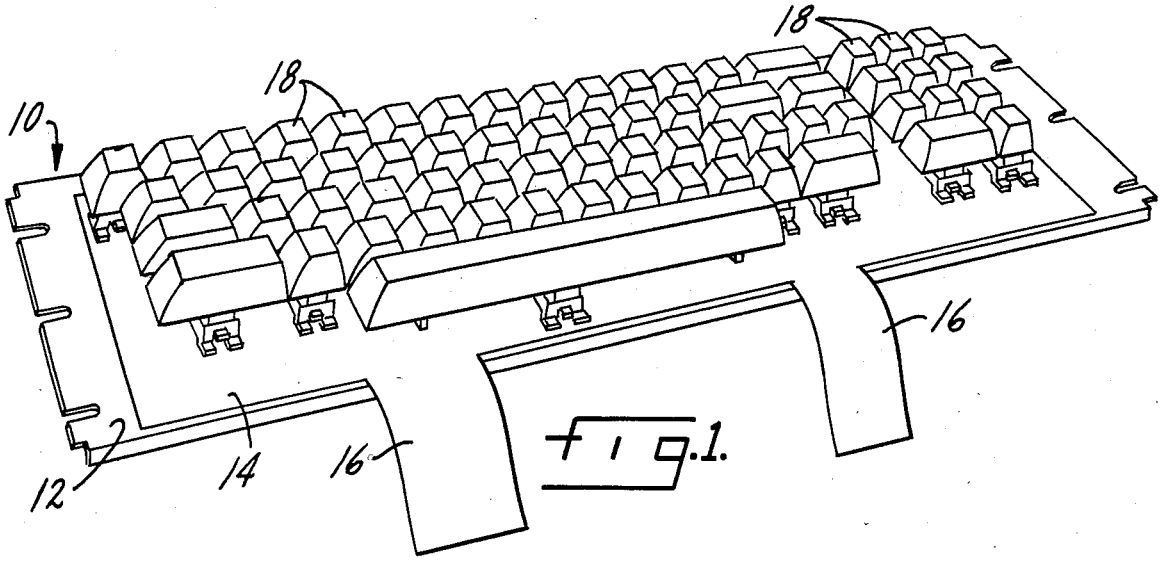
fig.1.
fig.2.
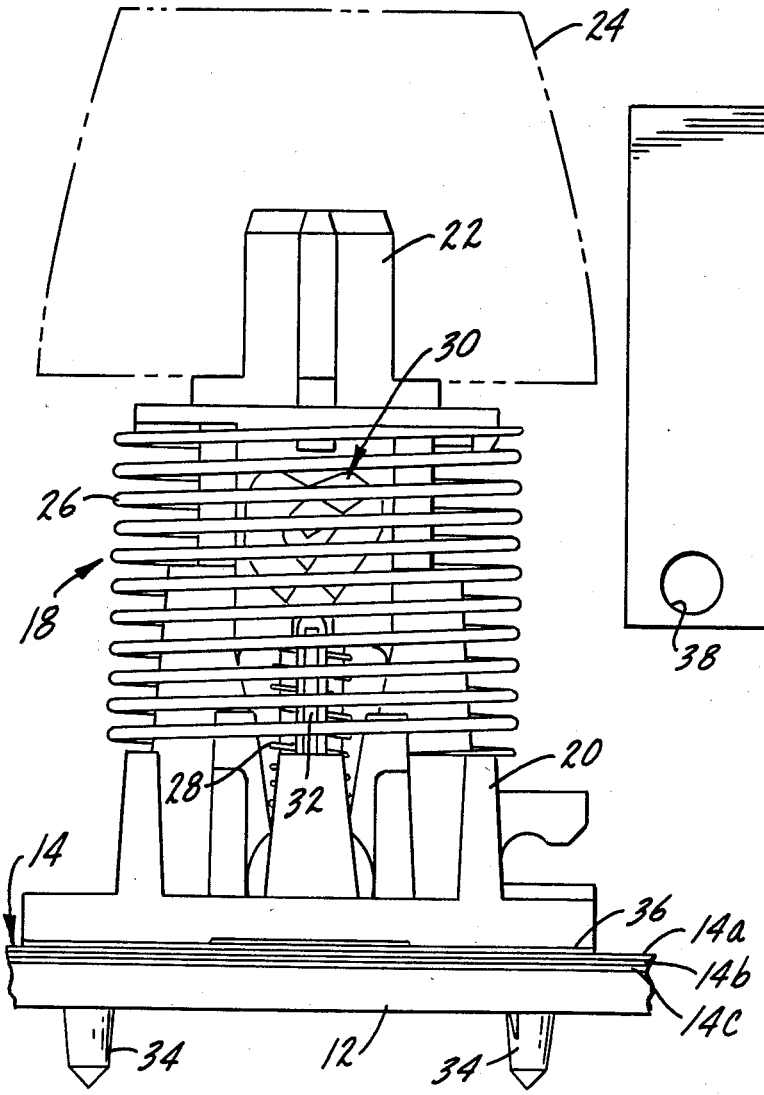
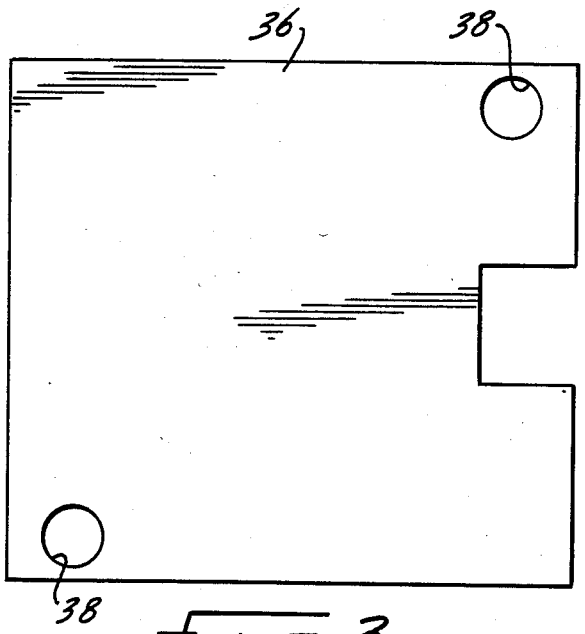
fig.3.

MEMBRANE SWITCH AND COMPONENTS HAVING MEANS FOR PREVENTING CREEP

SUMMARY OF THE INVENTION

This invention relates to electrical components having flexible membranes and in particular to a membrane switch incorporated in a keyboard.

A primary object of the present invention is the prevention of creep in membrane switches and other electrical components using flexible membranes.

Another object is a membrane switch panel which can be stored to elevated temperatures without danger of damage due to membrane creep.

Another object is the prevention of creep at specific locations in a membrane switch panel.

Other objects will appear in the following specification, drawings and claims.

BRIEF DESCRIPTION OF THE DRAWINGS

FIG. 1 is a perspective view of a keyboard having a membrane switch panel of the type for which the present invention is adapted.

FIG. 2 is a side elevation view of an individual key, adapted for alternate action, and having the creep prevention means of the present invention.

FIG. 3 is a plan view of a patch used with the key of FIG. 2.

DESCRIPTION OF A PREFERRED EMBODIMENT

This invention relates to membrane switches and their use in keyboard assemblies. The standard membrane switch comprises a membrane and substrate, one or both of which may be flexible, and each having a set of conductors formed thereon. An insulative spacer is disposed between the membrane and substrate. The spacer has a plurality of holes such that the conductors on the membrane may move into electrical contact with the conductors on the substrate in response to pressure on the membrane. In a keyboard assembly, this acutating pressure is applied by a plurality of actuator or keys.

Some of the keys will be the alternate action type. By this it is meant the key is depressed once to actuate the switch and it remains in the actuated position until a second application of pressure is made. Thus if the key is pushed only once it will remain in a depressed or latches position. When the key or actuator is in the latched position the membrane is deflected from its normal, generally flat position and is in tension. There may be instances when a keyboard assembly is stored prior to incorporation in some device, and the storage temperature may be at an elevated level. Some membrane materials are creep sensitive at these elevated temperatures. Creep is time-related strain. If an alternate action type key is left in the latched position while the keyboard assembly is stored at elevated temperatures, serious damage can result to the switch panel. The most serious creep will result in spontaneous and permanent actuation of a switch. The present invention provides a method and means for preventing membrane creep under the above-described conditions.

FIG. 1 shows a keyboard assembly 10 including a base 12 with a membrane switch panel 14 attached thereto. The membrane switch has a membrane and substrate separated by an intervening spacer, the spacer having holes. Electrical conductors (not shown) are formed on the membrane and substrate. The conductors may extend out onto one or more tails 16 for connection to auxiliary electronics. A plurality of actuators or keys 18 are attached to the base, on top of the membrane switch panel 14. In the keyboard shown the keys 18 are arranged in a standard typewriter configuration, together with an auxiliary panel at the right hand side of the keyboard. The usual typewriter configuration includes at least one key, such as a shift lock key, which is an alternate action type key. FIG. 2 shows such a key adapted for alternate action. The key includes a housing 20 and a plunger 22 movable within the housing and a keytop 24 attached to the top of the plunger 22. The plunger 22 is biased upwardly by a spring 26 which bottoms on the housing 20. A second spring 29 engages the plunger 22 and is the medium through which pressure is applied to the membrane switch for actuation. The plunger has a cam surface 30 which, together with a cam follower 32 provides the alternate action operation of the actuator.

As shown in FIG. 2, the membrane switch panel 14 includes a membrane **14*a*, a spacer 14*b* and a substrate 14*c*. The membrane switch panel may be made of a polyester sheet material, such as that sold under the trademark Mylar. The membrane switch panel may be affixed to the base 12 by a pair of legs 34** which are attached to the housing. The legs extend through openings in the membrane switch and base and may be staked thereto.

The means for preventing creep of the membrane include a path 36 of low creep material. Preferably the patch is made of stainless steel, on the order of 1 mil thick. The patch is located directly beneath the housing 20. The patch may have a pair of openings 38 (FIG. 3) through which the legs 34 extend to hold both the patch and the membrane switch in place. The patch is preferably attached to the membrane **14*a*** by an appropriate high temperature, high tack adhesive material, such as Dencryl 400 sold by Dennison Manufacturing Co. of Framingham, Md. The adhesive is applied as a dot whose diameter is about one-eighth of an inch. It has been found that this will eliminate any creep problem with the adhesive itself.

A patch may be placed on the membrane under each alternate action type actuator. The stainless steel patch will not creep even at the elevated storage temperature which would cause creep in the Mylar membrane. Even if a plunger is left in the actuated position during storage at high temperature, the patch will cause the membrane to return to its normal, undeflected position. In essence, the patch "pulls up" a membrane which might otherwise remain in an actuated position even after release of the actuator.

An alternate material for the patch is polycarbonate, such as that sold under the trademark Lexan. This material has the advantage of having high creep resistance and it is, relatively easy to handle. It does not present any sharp edges which could damage the membrane.

While the above discussion has been directed to membrane switches, it will be realized that the anti-creep patch could be used in other electrical components using flexible membranes. For example, membrane potentiometers and rotary switches are now being made. Some of these devices may have a membrane in a normally stressed condition where creep would be likely to occur. Application of a patch of low creep material as described above will assure that the membranes return to an unstressed position as intended.

While a preferred form of the invention has been shown and described, it will be understood by those skilled in the art that many modifications, alterations and changes could be made thereto.

We claim:

1. In a membrane switch of the type having a membrane and substrate, each with electrical conductors formed thereon, a spacer having an opening therein disposed between the membrane and substrate, with the membrane being movable, in response to selectively applied pressure, through a spacer opening into contact with an electrical conductor on the substrate, and means for preventing creep of the membrane, caused by maintained tension thereon from selectively applied pressure thereto, including a patch of low creep material affixed to the membrane at those portions of the membrane which are subject to creep.

2. The structure of claim 1 wherein the patch is made of stainless steel.

3. The structure of claim 2 wherein the patch is substantially 1 mil thick.

4. The structure of claim 1 further comprising a base and a plurality of pressure applicators, the membrane switch lying on the base with the actuators affixed to the base on top of the switch, at least one of said actuators being adapted for alternate action, there being a patch under each of the alternate action actuators.

5. The structure of claim 1 wherein the patch is made of polycarbonate.

6. The structure of claim 1 further characterized in that said patch of low creep material is positioned on said membrane on the side away from said spacer.

7. In a keyboard assembly, a base having a membrane switch thereon, a plurality of actuators attached to the base and adapted to actuate the membrane switch, at least one of said actuators being adapted for alternate action, and a patch of low creep material attached to the membrane under each alternate action actuator to prevent membrane creep should said actuator be left in an actuated position.

8. The structure of claim 7 wherein the patch is held in position by adhesive material.

9. The structure of claim 8 wherein the adhesive is applied as a dot of about one-eighth inch diameter.

10. The structure of claim 7 wherein the patch is made of stainless steel.

11. The structure of claim 10 wherein the patch is approximately 1 mil thick.

12. The structure of claim 7 wherein the actuator has a housing and the patch has substantially the same shape as the bottom of the housing.

13. The structure of claim 7 wherein the patch is made of polycarbonate.

14. The structure of claim 7 further characterized in that said membrane switch includes a membrane and substrate having electrical conductors formed thereon, and a spacer disposed between the membrane and substrate, said patch of low creep material being positioned on said membrane on the side away from said spacer.

* * * * *